United States Patent [19]

Jordan

[11] 4,164,970

[45] Aug. 21, 1979

[54] INFLATABLE BAG

[76] Inventor: Charles P. Jordan, 203 Fairlane Dr., Joliet, Ill. 60435

[21] Appl. No.: 800,326

[22] Filed: May 25, 1977

[51] Int. Cl.[2] ..... A45C 7/00

[52] U.S. Cl. ..... 150/3; 150/0.5; 206/522; 190/43

[58] Field of Search ..... 150/0.5, 1, 3; 206/522; 190/43

[56] References Cited

U.S. PATENT DOCUMENTS

| | | | |
|---|---|---|---|
| 1,318,652 | 10/1919 | Farkas | 150/3 |
| 2,437,057 | 3/1948 | Waters | 150/1 UX |
| 3,044,515 | 7/1962 | Eades | 150/0.5 UX |
| 3,470,928 | 10/1969 | Schwartz | 150/1 |
| 3,634,970 | 1/1972 | Williams | 206/522 X |
| 3,742,994 | 7/1973 | Pensak | 150/0.5 X |
| 3,998,304 | 12/1976 | Edgerton | 150/3 X |
| 4,044,867 | 8/1977 | Fisher | 206/522 X |

*Primary Examiner*—Donald F. Norton
*Attorney, Agent, or Firm*—Ernest Kettelson

[57] ABSTRACT

An inflatable bag comprising a peripheral side wall having a pluraity of inflatable cells of flexible sheet material surrounding a storage cavity, and end walls to enclose each opposite end of the cavity, which end walls similarly include an inflatable cell of flexible sheet material. An opening is provided for entrance into the storage cavity, which opening includes means to open and close such as by means of a zipper. Air valves are provided for inflating and deflating the inflatable cells of the peripheral side wall and the inflatable cells of each end wall. When the inflatable cells of the peripheral side wall are inflated with air, the rigidity of the peripheral side wall increases to support the peripheral wall at points around the periphery which are spaced apart from the longitudinal axis of the storage cavity. The cells of the end wall are similarly inflated to provide rigidity and support for each end wall. When so inflated, a large storage cavity is formed and the cells of the side and end walls inflated with air provide insulation for the storage cavity. When deflated, the bag may be folded into a compact unit for storage in a minimum of space.

4 Claims, 8 Drawing Figures

INFLATABLE BAG

BACKGROUND OF THE INVENTION

This invention relates to the field of inflatable containers of resilient sheet material, comprising interconnected panels to form the end and peripheral side walls.

In accordance with the present invention, an inflatable container is provided which includes a peripheral side wall and end walls, in which the peripheral side wall includes a plurality of inflatable cells of flexible sheet material. The greater the number of inflatable cells for a given dimensional wall area, the closer to a given geometric configuration can such wall area be maintained when it is inflated. If for example a wall panel of substantially flat geometric configuration has only one inflatable panel, when inflated it will tend to balloon into an ovular or circular configuration. By contrast, if such wall panel is made up of a plurality of inflatable cells, as taught by the invention described herein, the panel will more nearly retain its intended flat geometric configuration. Each cell being smaller, its ballooning dimension will be less. By reducing the ballooning dimension of each inflatable wall panel or cell, the storage cavity will likewise be increased.

SUMMARY OF THE INVENTION

It is an object of the invention to provide an inflatable container including inflatable wall portions having a plurality of inflatable cells for each such wall portion to improve the maintenance of a given geometric configuration of such container when inflated and to increase the storage capacity of such container when inflated.

It is an object of the invention to provide an inflatable container having a plurality of cells for each wall portion, and air passage means interconnecting said cells.

It is an object of the invention to provide an inflatable container having a peripheral wall portion encircling a storage cavity, said peripheral wall portion including a plurality of interconnected inflatable cells, and inflatable end wall means to enclose the ends of said cavity.

DESCRIPTION OF PREFERRED EMBODIMENT

Figure 1:
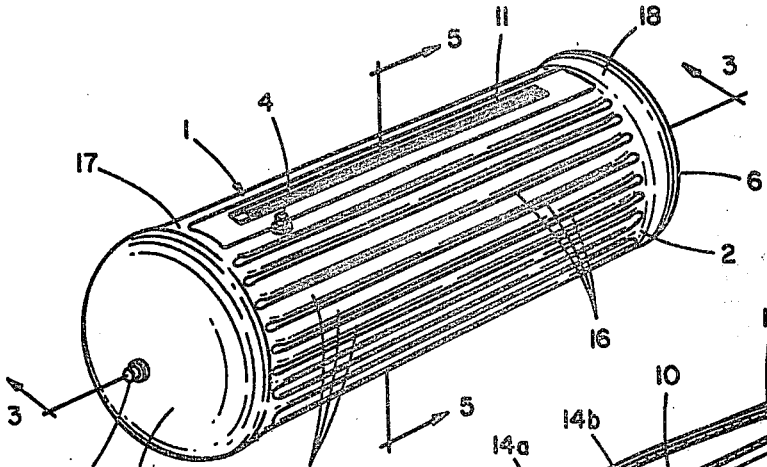
FIG. 1 is an isometric view of an inflatable container in accordance with this invention shown with its inflatable cells being inflated.

An inflatable container 1 includes a peripheral side wall 2 having a plurality of individual but interconnected inflatable cells 3. An air valve 4 is mounted on one of said inflatable cells 3. When air is pumped through the valve 4 into said cell 3, the air is forced into all of the interconnected inflatable cells 3 which make up the peripheral side wall 2. In the container shown, the peripheral side wall has a circular cross-sectional configuration, but the cross-sectional configuration of the peripheral side walls may be of other geometric shapes.

Inflatable end walls 5 and 6 are provided to enclose each end of the container 1 and of the storage cavity 7 bounded by said peripheral side wall 2 and end walls 5 and 6. Each end wall is provided with an air valve, such as air valve 8 for inflatable end wall 5 and air valve 9 for inflatable end wall 6.

An access opening 10 is provided in the peripheral side wall 2, the access opening 10 being openable and closeable by open and close means such as the zipper assembly 11.

Figure 5:
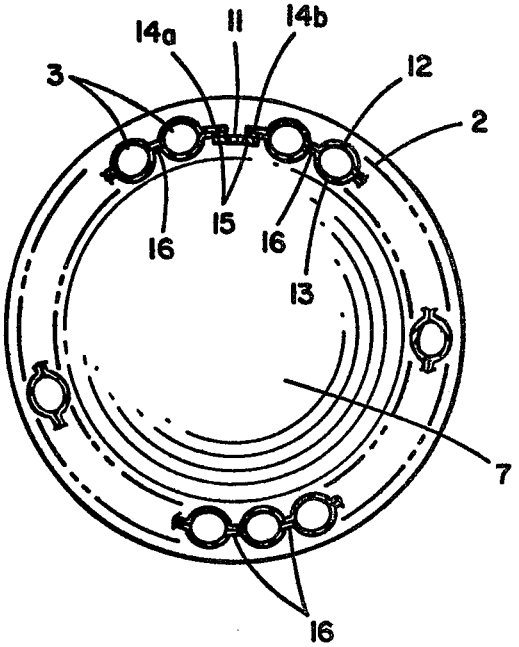
FIG. 5 is a section view taken on line 5—5 of FIG. 1.
Figure 6:
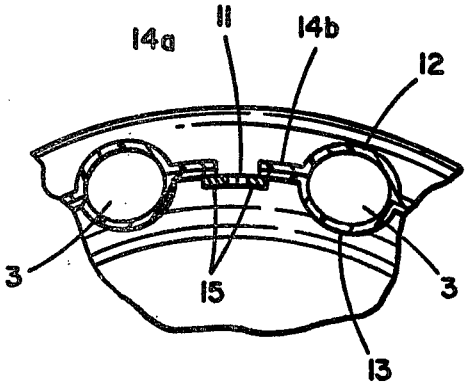
FIG. 6 is an enlarged fragmentary view of a portion of the section shown in FIG. 5.
Figure 7:
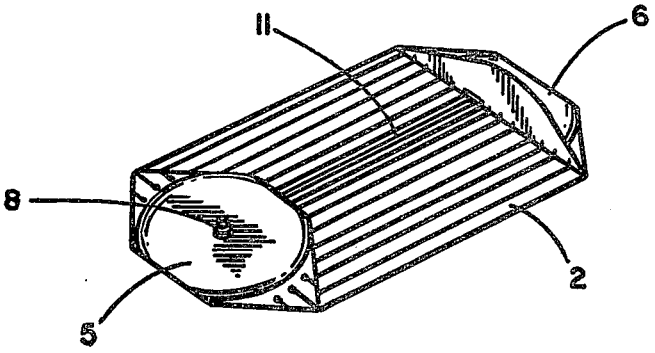
FIG. 7 is an isometric view of an inflatable container as shown in FIG. 1 but with its inflatable cells deflated.

The peripheral side wall 2 and its interconnected inflatable cells 3 are formed by two overlaid sheets 12 and 13 of flexible sheet material impervious to air, such as rubber, or a flexible plastic such as soft vinyl. The peripheral edges 14 of the overlaid flexible sheets are sealed such as by heat welding them together. In the modification shown, opposite peripheral edges **14*a* and 14*b* are brought together as shown in FIGS. 5 and 6 to form a circular or annular cross-sectional configuration of the peripheral side wall 2. The zipper assembly 11 is connected between the opposite peripheral edges 14*a* and 14*b* of the peripheral side wall 2, such as by heat welding to the longitudinal edges 15 of the zipper assembly 11. The opposite peripheral edges 14*a* and 14*b* of peripheral side wall 2 are substantially parallel when side wall 2 is not flexed or stretched out of its normal shape. Since side wall 2 is formed by two flexible sheets 12 and 13, the edges 14*a* and 14*b* may of course be moved out of such parallel relationship when the side wall 2** is flexed or stretched.

The individual inflatable cells 3 in the peripheral side wall 2 are formed by providing spaced apart longitudinal weld strips or boundary lines 16 which extend from the end region 17 near end wall 5 to the end region 18 near opposite end wall 6. The weld strips or boundary lines 16 are formed by heat welding or bonding flexible sheets 12 and 13 together along a substantial portion of the weld strips or boundary lines 16, leaving certain portions unwelded or unbonded and free to provide air passageways from one cell 3 to its adjacent cells 3 on each side thereof.

Figure 2:
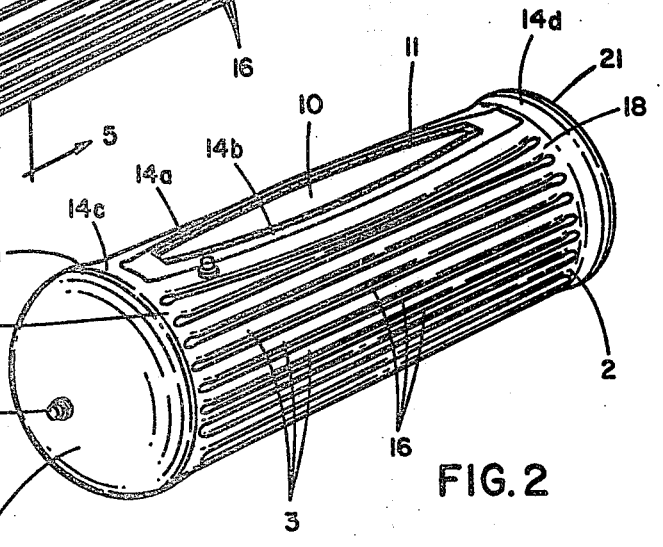
FIG. 2 is an isometric view of the inflatable container of FIG. 1 shown with its access opening in an open position.
Figure 3:
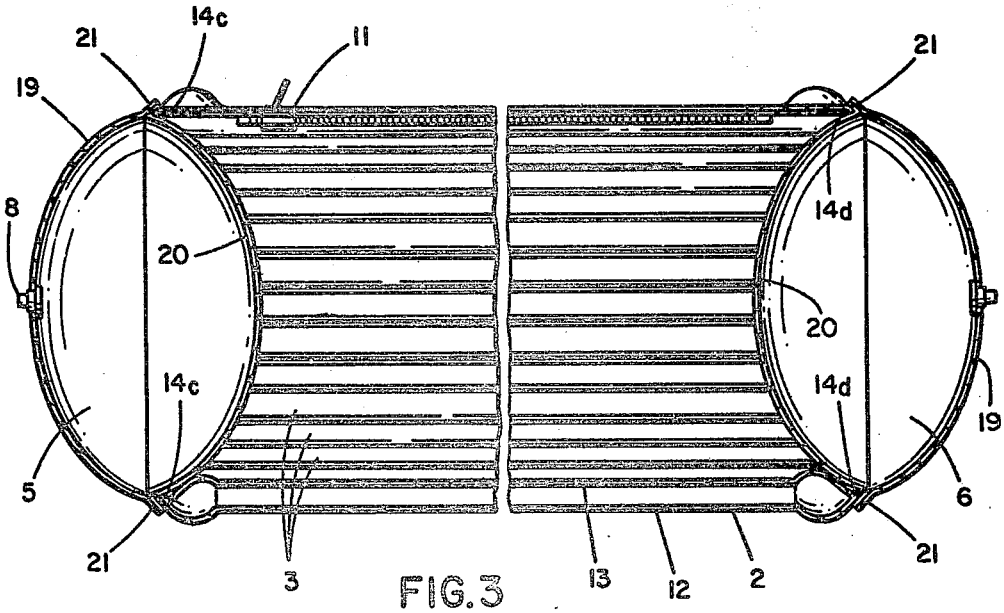
FIG. 3 is a section view taken on line 3—3 of FIG. 1.
Figure 4:
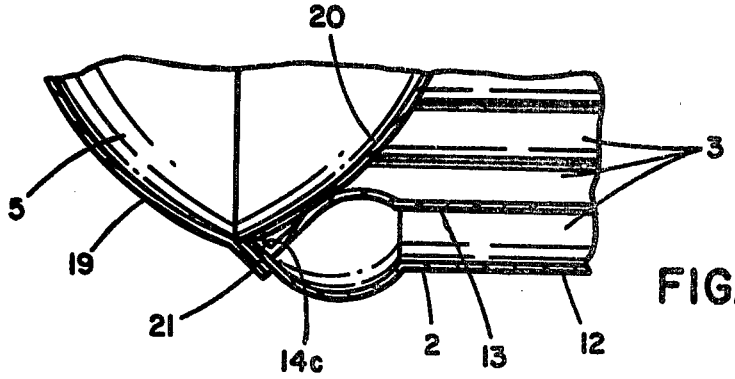
FIG. 4 is an enlarged fragmentary view of a portion of an end wall shown in FIG. 3.

The end walls 5 and 6 are similarly formed by two overlaid sheets 19 and 20 of flexible sheet material impervious to air such as rubber, or a flexible plastic material such as soft vinyl. The peripheral edges 21 of the overlaid flexible sheets are sealed such as by heat welding the sheets together, and the peripheral edges 21 of the end walls 5 and 6 are in turn bonded to the peripheral edges **14*c* and 14*d* of the peripheral side wall 2, to make a continuous watertight seal between the respective end walls 5 and 6 and the peripheral side wall 2. The peripheral edges 14*c* and 14*d* border opposite edges of the peripheral side wall 2 as shown in FIGS. 2 and 3. These edges 14*c* and 14*d* are substantially parallel when side wall 2 is not flexed or stretched out of its normal shape, and they are also substantially normal to edges 14*a* and 14*b* when peripheral wall 2** is unflexed and unstretched.

A tote bag modification can be made by omitting the inflatable end walls 5 and 6, and in lieu thereof bonding the opposite peripheral edges **14*c* and 14*d* of peripheral wall 2** together in an air tight and watertight seal, such as by heat welding. Alternatively, the peripheral edges 14*a* and 14*b* of peripheral wall 2 can be bonded together directly in an airtight, watertight seal, rather than to the zipper assembly assembly 11, thus making a completely imperforate peripheral side wall 2, and in such case only one of the other peripheral edges 14*c* or 14*d* would be bonded together in an air tight and watertight seal. For example, as shown in FIG. 8, edge 14*d* could be bonded together, leaving the opposite peripheral edge 14*c* open to provide an access opening into the storage cavity 7.

As shown in the drawings, the inflatable cells 3 of peripheral side wall 2 are closely adjacent each other to provide a substantially continuous insulated side wall to retard heat transfer from within the storage cavity 7 through the side wall 2 when the cells 3 are inflated with air. Also as shown in FIGS. 1–4 of the drawings, inflatable end walls 5 and 6 are directly joined in an airtight and watertight seal at each opposite end to peripheral side wall 2. Said end walls 5 and 6 are also inflatable throughout. Thus, when the end walls 5 and 6 are inflated with air, they provide insulated end walls to also retard heat transfer from within the storage cavity 7 through the end walls 5 and 6 when so inflated. When the access opening 10 is closed, the storage cavity 7 is thus bonded substantially continuously by insulated walls which retard heat transfer therethrough when inflated.

Figure 8:
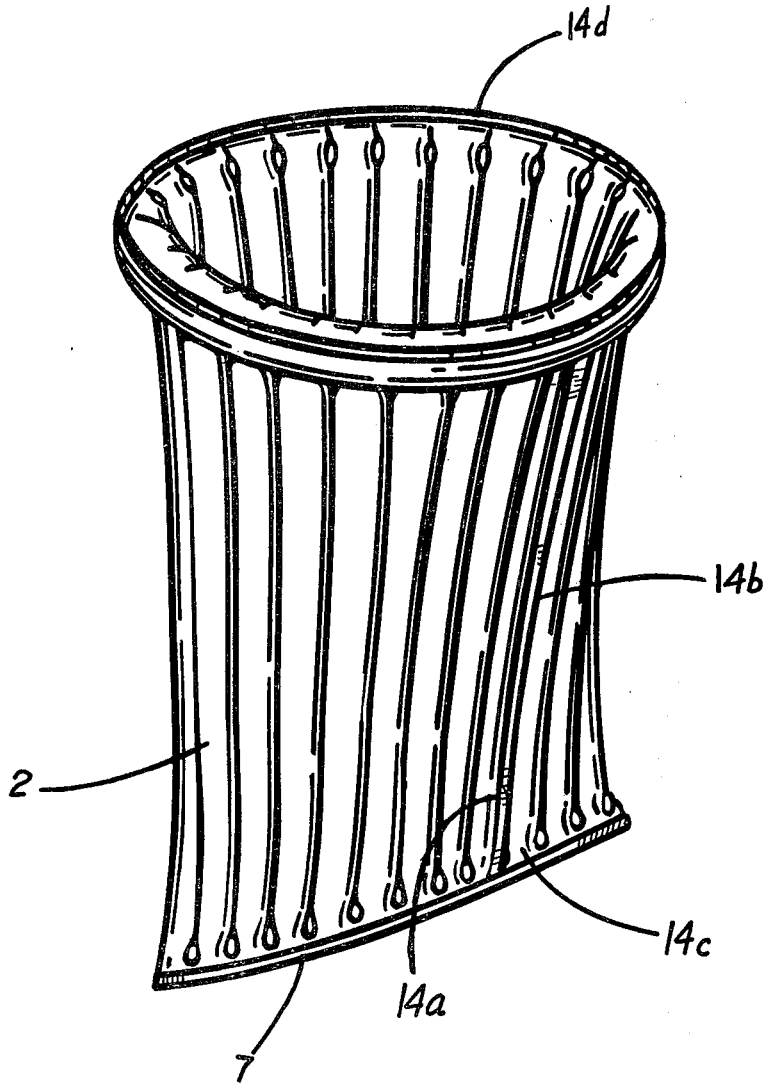
FIG. 8 is an isometric view of a modified inflatable container in accordance with this invention.

In the tote bag modification illustrated in FIG. 8, the substantially continuous insulated wall bounding storage cavity 7 is formed by bonding the opposite peripheral edges 14*c* and 14*d* of peripheral wall 2 together (or by bonding one of such peripheral edges together leaving the other unbonded to provide an access opening in a modification in which the zipper assembly 11 is omitted) as described above.

Thus the storage cavity 7 is both watertight and insulated against heat transfer into and out of said cavity. The inflatable bag in accordance with this invention may therefore be utilized as a portable refrigerator or cooling container by filling partially with ice together with whatever contents desired to be kept cool for a substantial length of time.

I claim:

1. An inflatable container, comprising an inflatable peripheral side wall of flexible sheet material, a plurality of inflatable cells in said peripheral side wall, and closure means to close at least one end of said peripheral side wall to form a container having a cavity bounded by said inflatable peripheral side wall and said closure means, wherein said inflatable peripheral side wall includes a first pair of opposite edges which are substantially parallel to each other when said side wall is unflexed, a second pair of opposite edges which are substantially parallel to each other and substantially normal to said first pair of opposite edges when said side wall is unflexed, said first pair of opposite edges being joined to encircle said cavity within said peripheral side wall, said closure means being formed by bonding together in an airtight and watertight seal at least one of said second pair of opposite edges to form said container into a tote bag, wherein said container includes an access opening for entry into said cavity, said inflatable cells in said peripheral side wall are closely adjacent each other to provide a substantially continuous insulated peripheral wall when inflated with air, said cavity being both watertight and insulated against heat transfer into and out of said cavity when said peripheral side wall is so inflated.

2. An inflatable container, comprising an inflatable side wall of flexible sheet material, a plurality of inflatable cells in said peripheral side wall, and closure means to close at least one end of said peripheral side wall to form a container having a cavity bounded by said inflatable peripheral side wall and said closure means, wherein said inflatable peripheral side wall includes a first pair of opposite side edges which are substantially parallel when said side wall is unflexed, a second pair of opposite side edges which are substantially parallel to each other and substantially normal to said first pair of side edges when said side wall is unflexed, said first pair of side edges being joined to encircle said cavity within said peripheral side wall, said closure means including a first inflatable end wall joined to one side edge of said second pair of side edges, and a second inflatable end wall joined to the other side edge of said second pair, said inflatable cells in said peripheral side wall being closely adjacent to each other, said inflatable end walls being inflatable throughout their entire dimensional area, said end walls being directly joined in a watertight and airtight seal at each opposite end to respective edges of said peripheral side wall, said cavity being both watertight and insulated against heat transfer into and out of said cavity when said peripheral side wall and said end walls are inflated with air.

3. An inflatable container as set forth in claim 2, including an access opening in said peripheral side wall.

4. An inflatable container as set forth in claim 3, including a zipper assembly mounted to said access opening.

* * * * *